US005636872A

United States Patent [19]

Gamer et al.

[11] Patent Number: 5,636,872

[45] Date of Patent: Jun. 10, 1997

[54] GOLF SCORE BOOKLET AND PROCESSES RELATED THERETO

[75] Inventors: Donald F. Gamer; Terry A. Gamer, both of West Hartford, Conn.; Diana M. Eagon, Huntington, W. Va.

[73] Assignee: Prestige Magazine Company, Inc., Huntington, W. Va.

[21] Appl. No.: 382,357

[22] Filed: Feb. 1, 1995

[51] Int. Cl.[6] ..... B42D 15/00

[52] U.S. Cl. ..... 283/49; 283/48.1; 281/15.1

[58] Field of Search ..... 283/48.1, 49, 56, 283/34; 281/42, 5, 43, 15.1; 273/32 H, 176 L; 434/252; 40/158.1, 124.1, 155

[56] References Cited

U.S. PATENT DOCUMENTS

| | | | |
|---|---|---|---|
| 3,552,290 | 1/1971 | Brechtel . | |
| 3,805,411 | 4/1974 | Andrews, Jr. . | |
| 3,883,161 | 5/1975 | McGee et al. | 283/50 |
| 3,949,987 | 4/1976 | Candor | 273/176 L |
| 4,331,425 | 5/1982 | Davis, Jr. . | |
| 4,492,390 | 1/1985 | Jacobs et al. . | |
| 4,666,156 | 5/1987 | Wakisaka | 273/32 H |
| 4,666,157 | 5/1987 | Bodine et al. | 273/32 H |
| 4,783,071 | 11/1988 | Tattershall | 273/32 H |
| 5,013,070 | 5/1991 | Maude, Sr. . | |
| 5,029,902 | 7/1991 | Komori . | |
| 5,094,451 | 3/1992 | Giamack . | |
| 5,103,299 | 4/1992 | Asaida . | |
| 5,146,548 | 9/1992 | Bijnagte . | |
| 5,155,589 | 10/1992 | Gere . | |
| 5,189,511 | 2/1993 | Parulski et al. . | |
| 5,212,546 | 5/1993 | Arazi et al. . | |
| 5,237,400 | 8/1993 | Washio . | |
| 5,264,914 | 11/1993 | Russell | 281/42 |
| 5,284,340 | 2/1994 | Laakso . | |
| 5,387,010 | 2/1995 | Mohr | 281/43 |

*Primary Examiner*—Frances Han

[57] ABSTRACT

A golf score booklet is provided. The booklet has a plurality of pages bound at a center line and graphically depicting the holes of a golf course. The booklet further includes a score card bound to the pages at the center line. The score card has a first section extending from the center line and a second section extending from the first section and attached thereto along a fold line. The second section has a scoring grid thereon. The booklet when opened to the score card may be held flat in a fashion that provides for planar view of a first page and its respective golf hole depiction, a second page and its advertisement and the second section and a scoring grid thereon for the depicted golf hole of the first page. A process is also provided for making enhanced graphic depictions of the golf course holes for the booklet, and preferably use laser measurement for determining the distance from the center of the green to landmarks.

12 Claims, 5 Drawing Sheets

GOLF SCORE BOOKLET AND PROCESSES RELATED THERETO

BACKGROUND OF THE INVENTION

1. Field of the Invention

The present invention relates to golf score booklets and processes related thereto, and more particularly relates to golf score booklets which assist golfers in playing the various holes of a golf course and keeping score and processes related to graphic depictions for such booklets.

2. Description of the Related Art

Golf is a challenging sport which is becoming increasingly popular. Golf players often represent an attractive market segment which advertisers of real estate, brokerage services and other high end services would like to expose their advertisements to. Golf courses typically provide players with a score card, and many provide cards or booklets which provide graphic depictions of the holes as well as giving various bits of information such as distances from various landmarks to the pin. Most booklets and cards do not provide a format which can be easily and conveniently clipped into a flat position to simultaneously exhibit a first page having a graphic depiction of the hole being played, a score card having a scoring grid matrix of a size suitable for standard golf scoring pencils, and a second page having suitable space for substantial display of advertising.

Prior combined score cards and/or booklets suffered from one or more deficiencies with respect to ease and convenience of use or with respect to adequacy of exposure of golfers to advertisements or other promotional messages when held in a flat clipped position in a conventional golf cart steering wheel clip. Consequently, conventional score cards and booklets typically fail to simultaneously display a graphic depiction of the hole, a respective golf score matrix, and an advertisement page and/or are inconvenient for clipping to a golf cart steering wheel clip and retention thereby without interfering with normal steering operation of the cart.

Additionally, the graphic depictions of the holes typically were lacking in either accuracy, detail, aesthetics, specificity and/or color contrast.

Accordingly, an object of the present invention is to provide a golf score booklet which will provide a flat open position which will simultaneously display a first page having a graphic depiction of the hole being played, a score card having a scoring grid matrix of a suitably large size and a second page having a suitable space for display of advertising. Additionally, there is a need for processes for improving the graphic depictions of golf course holes for such booklets and for accurately measuring the distances from landmarks to the center of golf course greens.

SUMMARY OF THE INVENTION

The present invention involves a golf score booklet having a plurality of pages bound at a center line including various pages having a graphic depiction of a respective golf course hole thereon. A score card is bound to the pages at the center line and has a first section which extends from the center line and has a second section foldably attached to the outer edge of the first section. The second section has a scoring grid matrix to permit the booklet in an open planar position to exhibit a first page having graphic depiction of a golf course hole, a score card having a second section having a respective scoring grid matrix thereon, and a second page between the first page and the second section for displaying advertising or promotional information. The booklet folds up for easy and convenient carrying in a pocket, and folds out in a compact planar fashion for easy and non-interfering retention in a golf cart steering wheel clip. The present invention also involves a process for providing an enhanced graphic depiction of a golf course hole and a process for hyper-accurate measurement of each golf course hole.

DETAILED DESCRIPTION OF THE INVENTION

Figure 1:
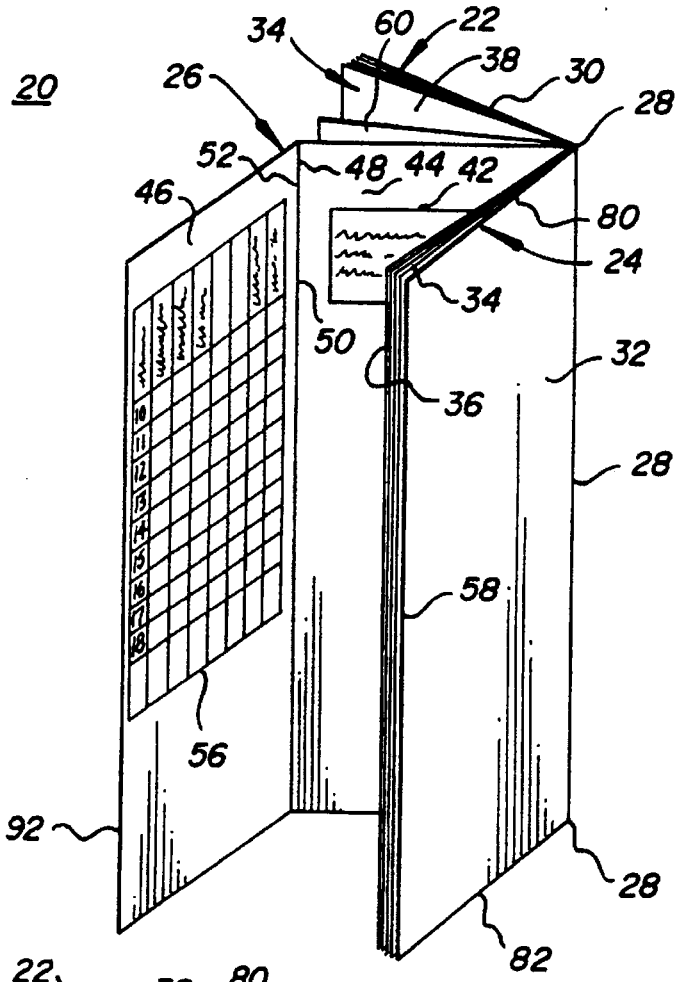
FIG. 1 is a perspective view of the booklet of the present invention in a partially open arrangement.

As shown in FIG. 1, a golf score booklet (20) has a first plurality (22) of pages (34), a second plurality (24) of pages (34) and a score card (26) positioned between the first plurality (22) and the second plurality (24). The first plurality (22), second plurality (24) and score card (26) are bound together in the booklet (20) at a center line (28) about which the pages and score card (26) fold for opening and closing of the booklet (20). The booklet (26) includes a front cover page (30) and a back cover page (32), and each page (34) of the pluralities (22, 24) has a front side (36) and a back side (38).

Figure 2:
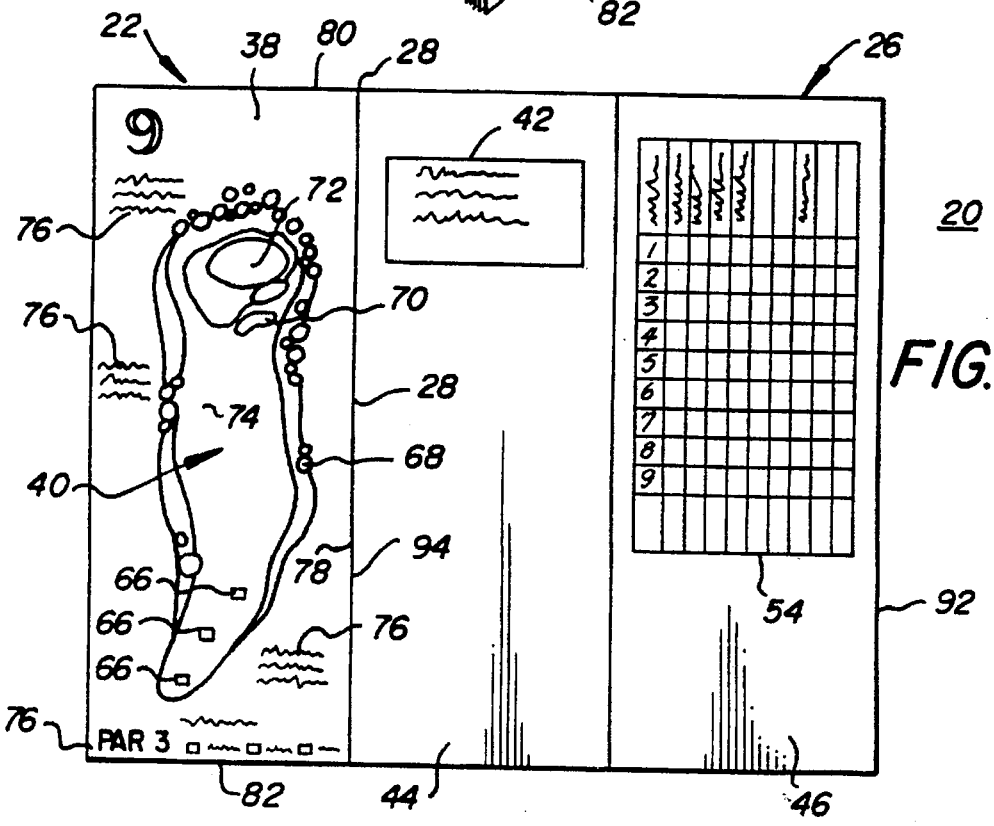
FIG. 2 is a view of the booklet of FIG. 1 in a planar opened position with the score card second section extended to exhibit the scoring grid matrix for the respective graphic depiction exhibited of a booklet pages of the first plurality of pages.
Figure 3:
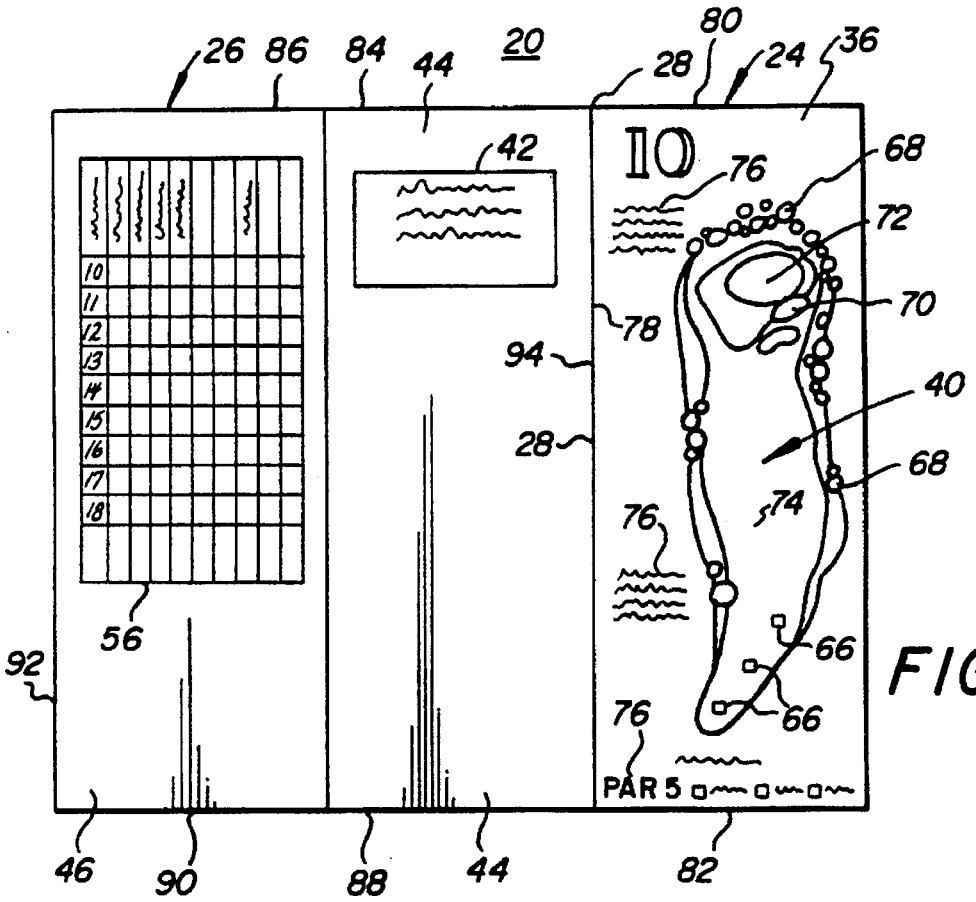
FIG. 3 is a view of the booklet of FIG. 1 in a planar opened position with the score card second section extended to exhibit the scoring grid matrix for the respective graphic depiction exhibited of a booklet pages of the second plurality of pages.

The first plurality (22) of pages have at least one page (34) having a graphic depiction (40) on a back side (38) thereof, as best shown in FIG. 2. The second plurality (24) of pages (34) has at least one page (34) having a graphic depiction (40) on a front side (36) thereof, as best shown in FIG. 3. The front sides (36) of each of the pages (34) of the first plurality (22) preferably contains an advertisement (42). The back sides (38) of each of the pages (34) of the second plurality (24) preferably contain an advertisement (42).

The score card (26) includes a first section (44) bound to the center line (28) and a second section (46) at an inner edge (52) thereof is longitudinally attached to an outer edge (48)

of the first section (44) parallel to the center line (28) and forming a fold line (50) thereat. The second section (46) of the score card (26) includes a golf score matrix (54, 56) thereon for recording of golf scores. As shown in FIGS. 2 and 3, the score card when positioned in its extended position provides a golf score matrix (54) for holes 1 to 9 when the depictions (40) of the first plurality (22) are exhibited and provides a golf score matrix (56) for holes 10 to 18 where the depictions (40) of the second plurality (24) are exhibited.

Figure 4:
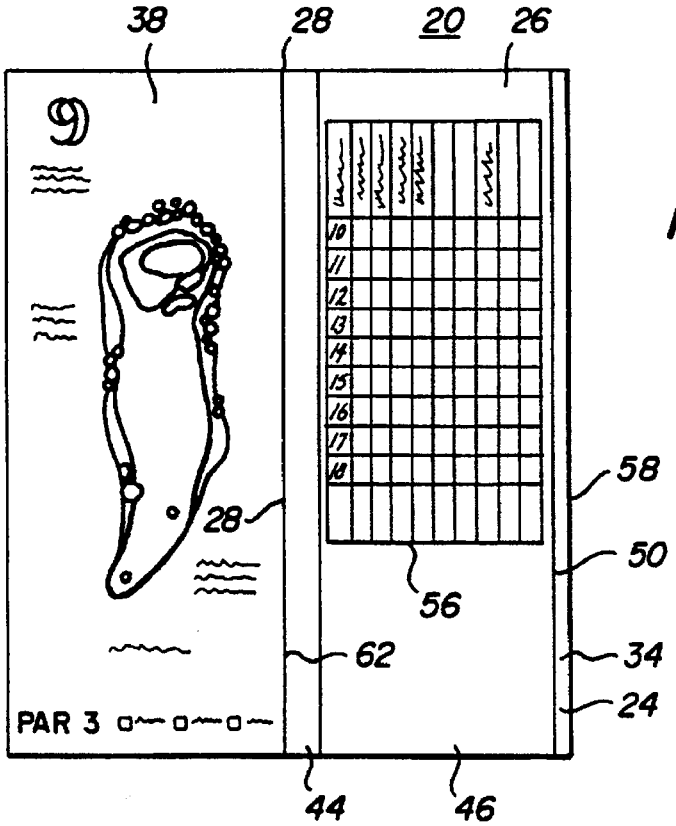
FIG. 4 is a view of the booklet of FIG. 1 opened to the score card with the second section of the score card in its folded position.

As shown in FIG. 4, when the booklet (20) is open to the score card (26), and the second section (46) is in its folded (non-extended) position, the first section (44) is smaller in width than the page (34) as evidenced by the position of the fold line (50) relative to the outer edge (58) of the pages (34). The greater width of the page (34) (and optionally a third section (60)) relative to the first section (44) facilitates the planar position of the booklet (20) by the outer edge (58) of the page (34) opposite the hole depiction (40) extending beyond the inner edge (52) of the second section (46). Optionally, and preferably the score card (26) includes the third section (60) (as shown only in FIG. 1) extending from the center line (28) and foldably attached to the first section (44) along the inner edge (52) thereof at the center line (28). In FIGS. 2, 3 and 4, the booklet does not have the third section (60), and if the third section (60) were present in FIG. 5, the third section (60) would be covered by the page (34) opposite the depiction (40) of hole 2.

Figure 5:
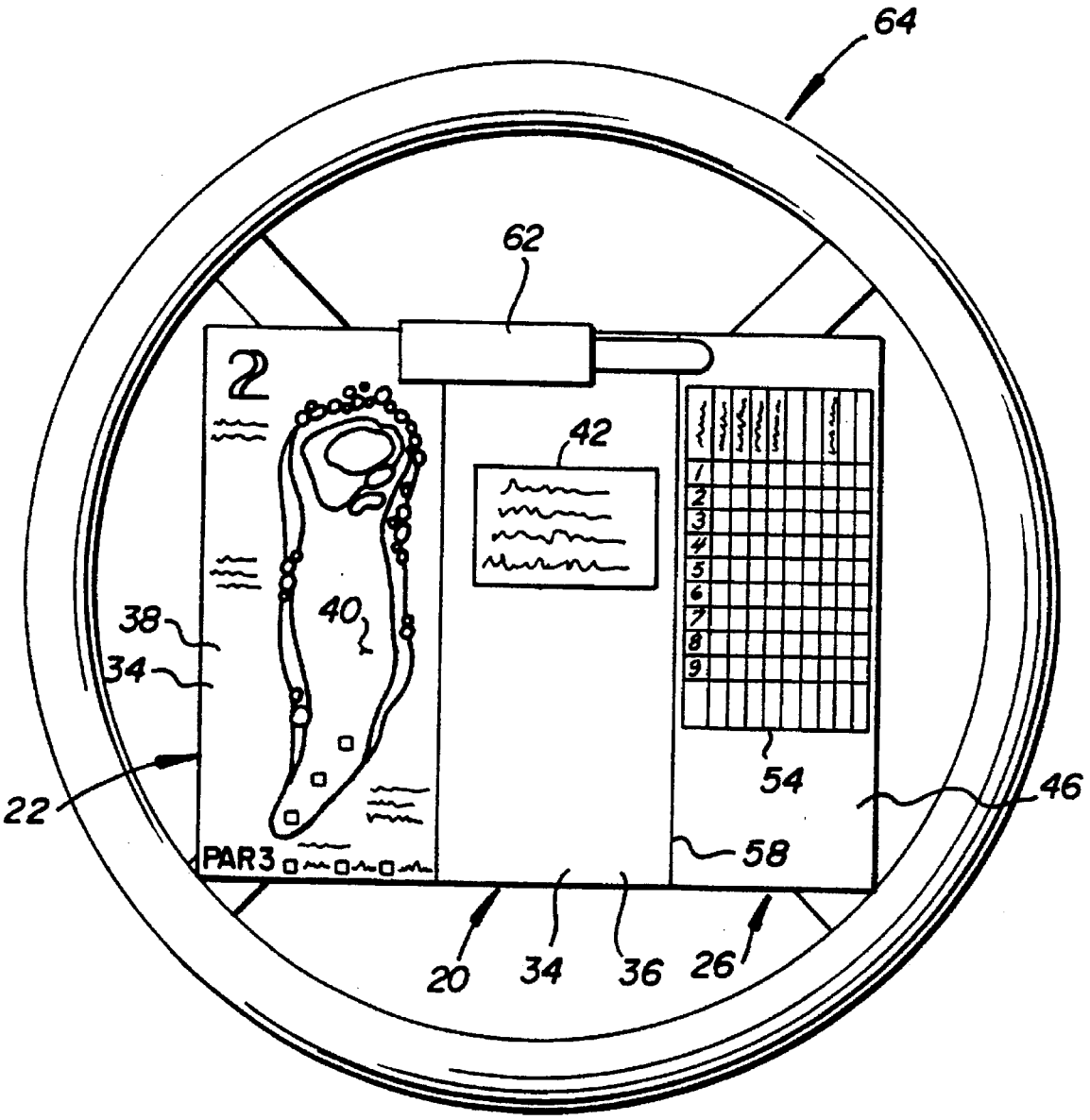
FIG. 5 is a view of the booklet of FIG. 1 opened as in FIG. 2 and clipped to a steering wheel clip of a golf cart for display of a graphic depiction of a golf course hole and a respective scoring grid matrix and an area therebetween for exhibition of advertisements.

As shown in FIG. 5, the booklet (20) is openable to a planar position wherein the second section (46) is extended, a back side (38) of a page (34) of the first plurality (22) is shown thereby displaying a graphic depiction (40) of a golf course hole (hole 2), and a front side (36) of a page (34) of the first plurality (22) is shown thereby displaying an advertisement (42). As shown in FIG. 5, the front side of the second section (46) displays a golf score matrix (54) for the first 9 holes of the golf course. The opened booklet (20) is held in its opened planar position by a clip (62) attached to a steering wheel (64) of a golf cart (not shown). The booklet (20), pages (34) and score card (26) are of height and weight sufficiently large enough for desired usage, but sufficiently small enough to fit within the circumference of a conventional golf cart steering wheel (64) for operation of the golf cart without interference of the golfers use of the steering wheel while the booklet (20) is clipped thereto in its open position as depicted in FIG. 5.

Preferably the pages (34) and sections (44, 46 and 60) are rectangular in shape. The pages (34) preferably have a length of between 7 inches and 8 inches, more preferably 7.25 inches and 7.75 inches, and more preferably 7.5 inches, and a width of between 3 inches and 4 inches, more preferably 3.25 inches and 3.75 inches, and most preferably 3.5 inches. The first section (44), second section (46) and third sections (60) preferably have lengths as set out above for the pages, and preferably are the same lengths as the pages. The first section (44) preferably has a width which is less than that of the pages (34), more preferably from 0.1 inch to 0.25 inches less than the pages, and most preferably is a width of about 3.25 inches. The second section (46) is preferably of width less than that of the first section (44), and is preferably between 0.1 inch and 0.25 inches less in width than the first section, and is preferably about 3.125 inches in width. The third section (60) may be of the same width as set out above for the pages (34). The pages are preferably of a relatively light weight and flexible compared to the score card which is a relatively heavier and stiffer card material. The steering wheel (64) preferably has a diameter of between 12 inches and 16 inches.

The graphic depictions (40) are sequentially arranged by hole number on respective pages within the booklet and illustrate the golf hole (the ninth hole in FIG. 2, the tenth hole in FIG. 3 and the second hole in FIG. 5), and the various natural and man made landmarks tee areas (66), trees (68), sand traps (70), greens (72), fairways (74) and rough. The side of the page containing the graphic depiction (40), preferably contains various information (76) about the respective golf hole. The side of the adjacent page opposite the graphic depiction (40) preferably contains an advertisement (42) or other promotional information which will be displayed when the booklet is in its open position for exhibiting a graphic depiction (40) during golfing play of the hole set out in the graphic depiction (40). Consequently, the booklet desirably exposes the player to the advertisement (42) during an entire period require to play a hole.

The pages (34) have inner longitudinal edges (78) at the center line (28) and outer longitudinal edges (58) parallel on the inner edges (78) and spaced apart therefrom. The pages (34) also have top edges (80) extending perpendicular from the inner edge (78) to the outer edge (58) and have bottom edges (82) spaced apart therefrom and parallel thereto. The first and second sections (44,46) have respective top edges (84, 86) and bottom edges (88, 90). The second section (46) has an outer edge (92); and the first section (44) has an inner edge (94) adjacent the center line (28).

In operation, the booklet (40) is opened to a graphic depiction (40) of the desired golf hole, the second section (46) of the score card (26) is extended, and the pages (34) opposite the hole depiction (as well as all other pages, if any, between the opposite page and the score card) are positioned over the first section (44) and overlap and extend beyond the fold line (50). For the first nine (1–9) holes, the booklet (40) in its planar position exhibits a graphic depiction (40) on the left, an advertisement on the front side (36) of the opposite page and a golf score matrix (54) for the first nine holes. The advertisement page is positioned centrally between the hole depiction page and the second section (46). For the second nine holes (10–18), the hole depiction (40) is on the front (36) of a page (34) and is on the far right side, the golf score matrix (56) of the second section (46) is on the far left, and the advertisement (42) (on the back side (38) of the page (34) opposite the hole depiction (40)) is located between the second section (46) and the page (34) exhibiting the hole depiction (40). Before and after usage, the second section (46) may be folded into the booklet (20) and the booklet (20) may be easily carried in a shirt pocket (not shown).

The steering wheel clip (62) is preferably from 3 to 4 inches in length.

The color enhanced images may be made by (1) making an aerial photograph of the golf course hole to produce a photographic image, (2) digitally scanning the photograph image into a computer such as an Apple Macintosh, IBM/MS-DOS type system, Sun Microsystem work station or other suitable computer system for containing and manipulating digital images, (3) shaping of the image to remove images of the terrain surrounding the hole, (4) sculpting of the image to enhance the three dimensional effect of the photo by enhancing the definition of the images elements, (5) color modification of the image by color enhancement, color correction and/or color change, (6) removal of clutter from the image such as electric lines and golfers, (7) indicating landmarks on the image by highlighting, drawing or adding indicia to the image, (8) detailing of the image to clearly present the topography of the hole, (9) adding indicia to precisely indicate the laser measured distances from the center of the green to various landmarks and accurately placing the indicia on the image because a small inaccuracy on the image can be a large inaccuracy on the golf course (for example, ⅛ inch on the image can translate to 100 feet on the golf course, depending on the image and hole size).

Figure 6:
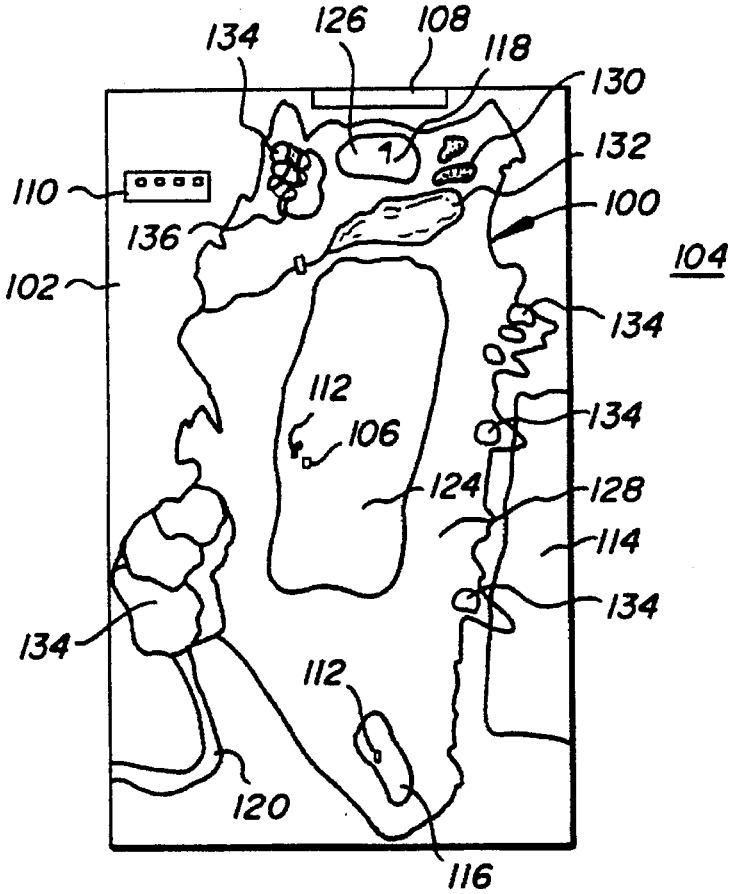
FIG. 6 is an illustration of a rectangular aerial photographic image of a golf hole and surrounding terrain of a golf course.
Figure 7:
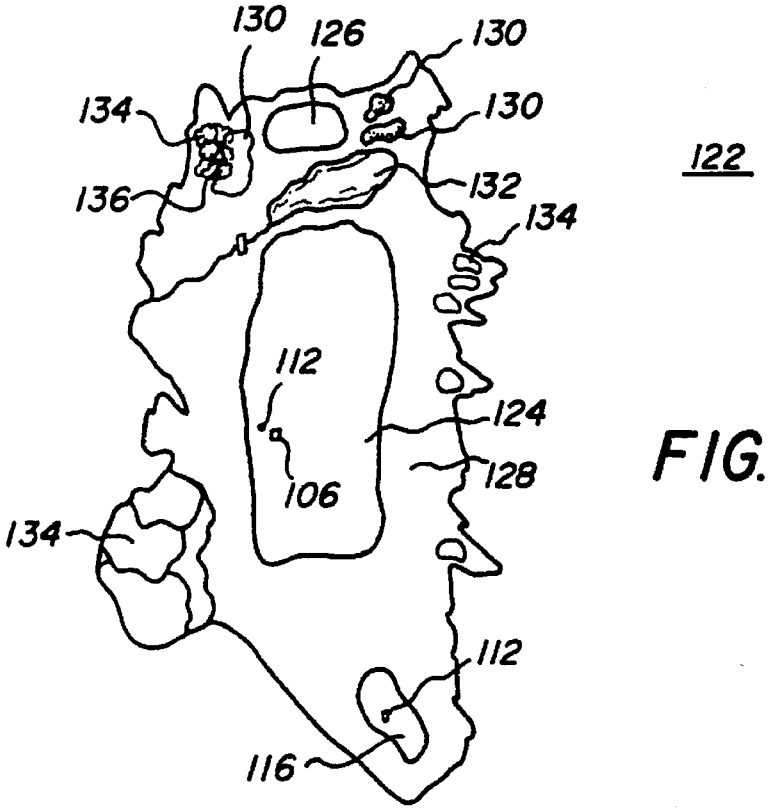
FIG. 7 is a shaped photographic image of FIG. 6 with the surrounding terrain images removed.
Figure 8:
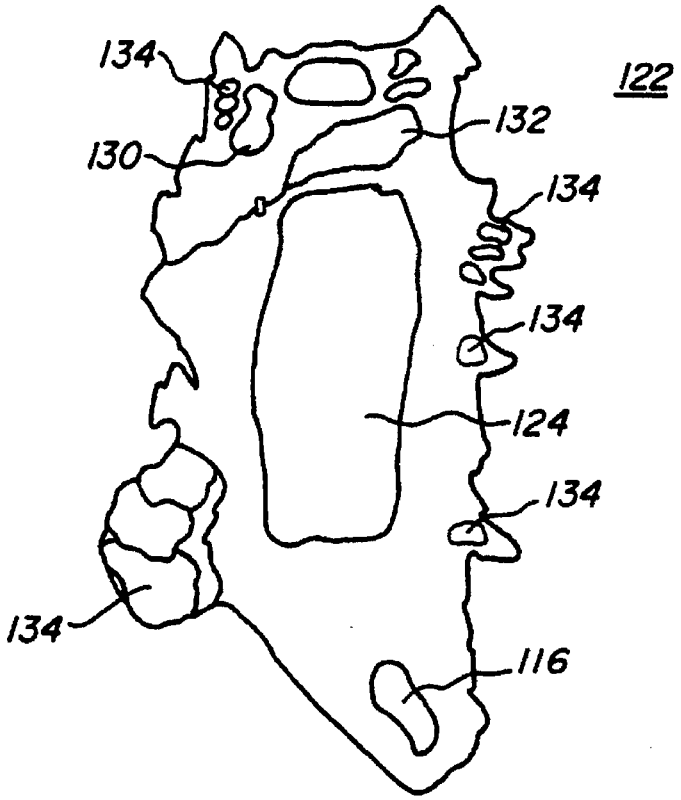
FIG. 8 is a color enhanced image of the image of FIG. 7 with various clutter removed therefrom.
Figure 9:
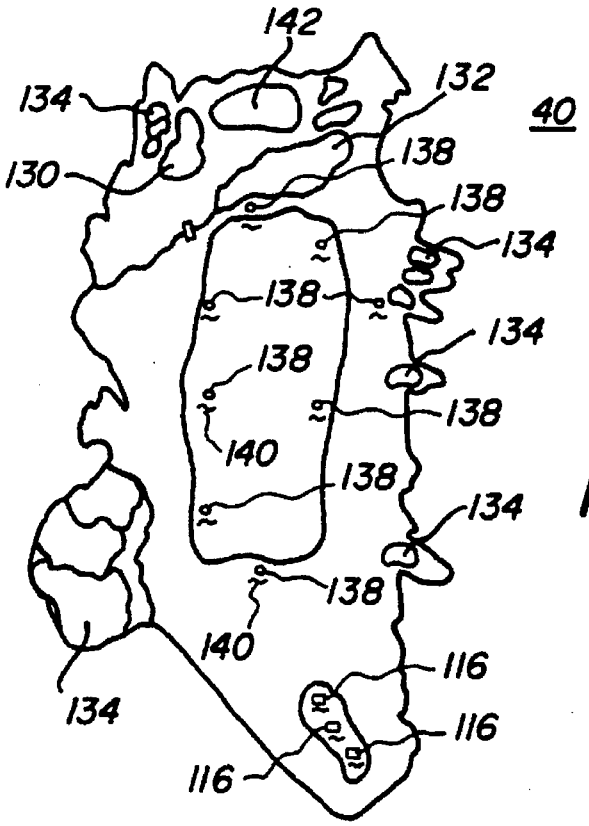
FIG. 9 is the image of FIG. 8 with addition of various laser precise distance indicia thereon.

The graphic depiction (40) as best shown in FIG. 9 is a computer color enhanced photographic depiction (40) prepared by (1) photographing a golf course hole (100) and surrounding terrain (102) to produce a rectangular photographic image (104) of the hole (100) and surrounding terrain (102) (see FIG. 6), (2) removing an amount of the surrounding terrain (102) images from the photographic image (104) of the hole to produce a shaped photographic image of the hole (see FIG. 7), (3) color enhancement of the image preferably enhancing at least the fairway (124) of the hole (see FIG. 8), (4) adding indicia to the color enhanced image to indicate the distances from landmarks (138) on the hole to the geographical center (142) of the green (see FIG. 9).

Photographing a golf course hole (100) will generally generate a photograph containing surrounding terrain (102) and undesirable clutter such as sub-images of golf carts (106), golf course maintenance equipment (not shown), golf course maintenance personnel (not shown), club house (108), driving range (110) and golfers (112). The surrounding terrain (102) in the photograph (104) is usually distractive and unnecessary, and can confuse the golfer and may include irrelevant images such as the adjacent hole (114). Photographing a golf course hole is preferably done at an elevated position at position behind the tee (116) to yield an aerial photograph having the tee (116) positions at the bottom of the photo and the pin at the top of the photo.

The image (104) is then shaped to show only the specific hole (100) by removing the surrounding terrain images (102) such as the club house (108), surrounding golf cart paths (120), and adjacent holes (114). This shaping/removing can be done with the assistance of the resident golf professional of the golf course to carefully retain only the relevant hole terrain and landmarks.

The shaped hole image (122) is then subjected to color enhancement to better define and aesthetically present the key features of the hole including the fairway (124), the tee (116), the green (126), the rough (128), sand traps (130), water hazards (132), and trees (134). Unenhanced aerial photographs (104) of golf course holes typically show only very slight contrast between various shades of light green-brown thereby leaving the view without a sharp contrast between the key playing areas of the hole. Color enhancement allows for a sharp contrast between the areas within the images. Color enhancement is preferentially achieved through digitization of the image and color shift and color intensification of the key features of the image. Preferably, the water hazards (132) which typically appear brown in aerial photos (104) are color shifted to a shade of blue to make the water hazard (132) in the color enhanced images of FIGS. 8 and 9 appear more aesthetically pleasing. Typically, the tee (116) and fairway (124) in aerial photos are light brownish green. The tee (116), green (126) and main fairway (124) are preferably color intensified to a light emerald green from a much paler greenish yellow, the area immediately surrounding the green (126) is shifted from a brownish green to an emerald green darker than that of the green (126).

The digitized image is preferably also adjusted to remove clutter such as golf carts (106) and golfers (112) and shadows (136) are removed from the images of the fairway (124) and traps (130) to avoid unintentional distortion or coverage of their shape.

Distances from the green (126) to various landmarks (138) is preferably measured with a laser distance measurement device (not shown) which is preferable to over the land measurement approaches such as tapes or the aerial photo interpolation and translation methods previously used. The enhanced accuracy of the laser system allowed for a more appropriate selection of golf clubs for the players. The laser distance measurements are preferably made from the center (142) of the green (126) to the landmarks (138), and the most appropriate landmarks (138) for measurement may be selected by the local golf professional and indicia (140) may be placed on the color enhancement image to designate the distances.

Various image color enhancement processes and apparatus are known and are incorporated herein by reference: Gere, U.S. Pat. No. 5,155,589, issued Oct. 13, 1992, Washio et al., U.S. Pat. No. 5,237,400, issued Aug. 17, 1993, Arazi et al., U.S. Pat. No. 5,212,546, issued May 18, 1993, Parulski et al., U.S. Pat. No. 5,189,511, issued Feb. 23, 1993, Bijnagte, U.S. Pat. No. 5,146,548, issued Sep. 8, 1992 and Asaida, U.S. Pat. No. 5,103,299, issued Apr. 7, 1992.

Various laser distance measurement devices are known such as U.S. Pat. No. 4,929,082, U.S. Pat. No. 4,926,050, U.S. Pat. No. 4,744,653 and U.S. Pat. No. 4,492,464 all of which are incorporated herein by reference. Laser measuring and subsequent indicia marking is done in the present invention by standing at center of the green with a conventional laser transit system and sending a laser beam to a reflective mirrored prism device held at the edge of the landmark (138) to measure the distance typically within an accuracy of plus or minus an inch, and an expanded aerial photograph (typically 8 inches by 10 inches) is color copied to produce an enlarged color copy (typically 8 inches by 10 inches) and is marked with the yardage measurement for reduction and color enhancement with accurate representation of the distance from the landmark (138) to the center (142) of the green (126).

Preferably the first plurality (22) comprises at least nine pages (34), and preferably the second plurality (24) comprises at least nine pages (34).

We claim:

1. A golf score booklet having a plurality of pages bound at a center line, at least one of said pages having a graphic depiction of a portion of a golf course, said booklet comprising:

(A) a score card bound to said pages at said center line, said score card having a first card section having a first edge parallel to said center line and having a second edge opposite from said first edge and spaced apart from said center line, and said score card having a second card section having a first edge attached to said second edge of said first section and forming a fold line thereat, said second section having a scoring grid thereon, said booklet being openable to a planar position displaying said graphic depiction and said scoring grid simultaneously.

2. The booklet of claim 1 wherein said booklet comprises at least 18 pages.

3. The booklet of claim 1 wherein said second section of said score card comprises two sides.

4. The booklet of claim 1 wherein said booklet has a first plurality of pages and second plurality of pages, said score card being located between said first and second pluralities when said booklet is closed.

5. The booklet of claim 4 wherein said first plurality of pages forms a left hand portion of the booklet relative to the center line when the booklet is opened at the score card, and said second plurality of pages forms a right portion of the booklet relative to the center line when the booklet is opened at the score card.

6. The booklet of claim 4 wherein said first section contains advertising indicia and is positioned between a graphic depiction and a scoring grid when said booklet is in an open planar folded out position and the second section is extended.

7. The booklet of claim 4 wherein said pages each have a front side and a back side, said first plurality of pages each having a graphic depiction of a hole of a golf course on the backsides thereof, and said second plurality of pages each having a graphic depiction on the front side thereof.

8. The booklet of claim 7 wherein said second section in a folded out position has a scoring grid for the holes of the first plurality of pages on the front side thereof, and a scoring grid for the holes of the second plurality of pages on the back side thereof.

9. The booklet of claim 1 wherein said pages have a length of between 7 and 8 inches and width between 3 and 4 inches, said first and second card sections having a length of between 7 and 8 inches, said first section having a width of 0.1 to 0.25 inches less than the pages, and said second section having a width of 0.1 inches and 0.25 inches less than the first section.

10. The booklet of claim 1 wherein said pages are a made of a relatively light weight and flexible material compared to the score card which is a relatively heavier and stiffer card material.

11. The booklet of claim 1 where said booklet comprises a first plurality of pages comprising at least nine pages and a second plurality of pages comprising at least nine pages, said score card being positioned between the first plurality of pages and the second plurality of pages, said first plurality of pages having graphic depictions of golf course holes on the back sides thereof and said second plurality of pages having graphic depictions of golf course holes on the front sides thereof, said booklet when in an open planar position with said score card being in an extended position provides a golf score matrix for holes 1 to 9 when the depictions of the first plurality of pages are exhibited and provides a golf score matrix for holes 10 to 18 when the depiction of the second plurality are exhibited.

12. A golf score booklet having a plurality of pages bound at a center line, at least one of said pages having a graphic depiction of a portion of a golf course, said booklet comprising:

(a) a score card bound to said pages at said center line, said score card having a first section bound at said center line and having a second section bound at said center line, said second section having a scoring grid thereon, said first section having a smaller width than said pages to facilitate outer edges of said pages to extend beyond an inner edge of said second section when the booklet is an open planar position with the score card being extended.

* * * * *